US005171420A

United States Patent [19]

Forester

[11] Patent Number: 5,171,420

[45] Date of Patent: Dec. 15, 1992

[54] METHOD FOR CONTROLLING FOULING DEPOSIT FORMATION IN A LIQUID HYDROCARBONACEOUS MEDIUM

[75] Inventor: David R. Forester, Conroe, Tex.

[73] Assignee: Betz Laboratories, Inc., Trevose, Pa.

[21] Appl. No.: 756,520

[22] Filed: Sep. 9, 1991

[51] Int. Cl.[5] ..... C10G 9/12; C10G 9/16

[52] U.S. Cl. ..... 208/48 AA; 208/48 R; 208/47; 585/950

[58] Field of Search ..... 208/48 AA; 585/950

[56] References Cited

U.S. PATENT DOCUMENTS

| | | | |
|---|---|---|---|
| 2,993,771 | 6/1961 | Stromberg | 208/48 AA |
| 3,030,387 | 4/1962 | Benoit, Jr. | 208/48 AA |
| 3,172,892 | 3/1965 | Suer et al. | 260/326.5 |
| 3,224,957 | 12/1965 | Kent | 208/48 AA |
| 3,235,484 | 2/1966 | Colfer | 208/48 |
| 3,271,295 | 9/1966 | Gonzales | 208/48 AA |
| 3,271,296 | 9/1966 | Gonzales | 208/48 AA |
| 3,412,029 | 11/1968 | Andress, Jr. | 208/48 AA |
| 3,437,583 | 4/1969 | Gonzalez | 208/48 |
| 3,442,791 | 5/1964 | Gonzales | 208/48 AA |
| 3,483,133 | 12/1964 | Hatch | 208/48 AA |
| 3,567,623 | 3/1971 | Hagney | 208/48 AA |
| 3,776,835 | 12/1973 | Dvorack | 208/48 AA |
| 4,401,581 | 8/1983 | Burrows et al. | 252/51.5 |
| 4,578,178 | 3/1986 | Forester | 208/48 |
| 4,775,459 | 10/1988 | Forester | 208/48 |
| 4,883,886 | 11/1989 | Huang | 549/255 |

*Primary Examiner*—Helane Myers

*Attorney, Agent, or Firm*—Alexander D. Ricci; Bruce E. Peacock

[57] ABSTRACT

Reaction products of (a) hydrocarbon substituted succinic acid or anhydride, (b) mono to hexa-hydroxy alcohols, (c) primary or secondary hydroxy substituted amines, (d) polyalkenylsuccinimide, and (e) a polyoxyalkyleneamine, are effective antifoulants in liquid hydrocarbonaceous mediums, such as in crude oils and gas oils. The reaction products are fed to the liquid hydrocarbon during elevated heat temperature processing of the hydrocarbon so as to inhibit fouling that would otherwise occur.

13 Claims, No Drawings

METHOD FOR CONTROLLING FOULING DEPOSIT FORMATION IN A LIQUID HYDROCARBONACEOUS MEDIUM

FIELD OF THE INVENTION

The present invention pertains to the use of certain reaction products derived from polyalkenylsuccinic acid or anhydride that are useful in inhibiting fouling in liquid hydrocarbon mediums during the heat treatment of the medium such as in refinery processes.

BACKGROUND OF THE INVENTION

In the processing of petroleum hydrocarbons and feedstocks, such as petroleum processing intermediates, and petrochemicals and petrochemical intermediates, e.g., gas, oils and reformer stocks, chlorinated hydrocarbons and olefin plant fluids, such as deethanizer bottoms, the hydrocarbons are commonly heated to temperatures of 40° to 550° C., frequently from 200°-550° C. Similarly, such petroleum hydrocarbons are frequently employed as heating mediums on the "hot side" of heating and heating exchange systems. In both instances, the petroleum hydrocarbon liquids are subjected to elevated temperatures which produce a separate phase known as fouling deposits, within the petroleum hydrocarbon. In all cases, these deposits are undesirable by-products. In many processes, the deposits reduce the bore of conduits and vessels to impede process throughput, impair thermal transfer, and clog filter screens, valves and traps. In the case of heat exchange systems, the deposits form an insulating layer upon the available surfaces to restrict heat transfer and necessitate frequent shut-downs for cleaning. Moreover, these deposits reduce throughput, which of course results in a loss of capacity with a drastic effect in the yield of finished product. Accordingly, these deposits have caused considerable concern to the industry.

While the nature of the foregoing deposits defies precise analysis, they appear to contain either a combination of carbonaceous phases which are coke-like in nature, polymers or condensates formed from the petroleum hydrocarbons or impurities present therein and/or salt formations which are primarily composed of magnesium, calcium and sodium chloride salts. The catalysis of such condensates has been attributed to metal compounds such as copper or iron which are present as impurities. For example, such metals may accelerate the hydrocarbon oxidation rate by promoting degenerative chain branching, and the resultant free radicals may initiate oxidation and polymerization reactions which form gums and sediments. It further appears that the relatively inert carbonaceous deposits are entrained by the more adherent condensates or polymers to thereby contribute to the insulating or thermal opacifying effect.

Fouling deposits are equally encountered in the petrochemical field wherein the petrochemical is either being produced or purified. The deposits in this environment are primarily polymeric in nature and do drastically affect the economies of the petrochemical process. The petrochemical processes include processes ranging from those where ethylene or propylene, for example, are obtained to those wherein chlorinated hydrocarbons are purified.

Other somewhat related processes where antifoulants may be used to inhibit deposit formation are the manufacture of various types of steel or carbon black.

SUMMARY OF THE INVENTION

In accordance with the invention, I have found that certain reaction products based on polyalkenylsuccinic acid or its anhydride, inhibit fouling of heated liquid hydrocarbon mediums. Typically, such antifoulant protection is provided during heat processing of the medium, such as in refinery, purification or production processes.

The reaction products are formed from components (a), (b), (c), (d), and (e) wherein:

(a) is a hydrocarbon substituted succinic acid or anhydride wherein the hydrocarbon moiety substituent has an average weight of from about 700-5000;

(b) is a 1-6 OH containing alcohol;

(c) is a primary or secondary hydroxy substituted amine containing 1-3 hydroxyl groups;

(d) is a polyalkenylsuccinimide formed via reaction of a (i) polyalkenylsuccinic acid or its anhydride, with (ii) a polyamine; and (e) is a polyoxyalkyleneamine.

PRIOR ART

The reaction products used as process side antifoulants in accord with the invention are not new. In fact, same are disclosed in U.S. Pat. No. 4,401,581 (Burrows et al) as being useful as ashless dispersants in automotive crankcase lubricating oils. The '581 disclosure indicates that the subject reaction products exhibit "reduced piston lacquer deposition characteristics when used in internal combustion engines. In contrast, the present invention calls for inhibition of fouling in liquid hydrocarbonaceous mediums during the high temperature processing of the medium. Studies have indicated that many compounds known to be useful as lubricating oil detergent-dispersants do not adequately function as process antifoulants.

U.S. Pat. No. 3,235,484 (Colfer et al) discloses amine reaction products of succinic acid and succinic anhydrides for the inhibition of the formation of harmful carbonaceous materials in refinery cracking units. U.S. Pat. No. 3,172,892 (LeSuer et al) teaches the use of high molecular weight succinimides as dispersants in lubricating compositions with Gonzalez, in U.S. Pat. No. 3,437,583 teaching combinations of metal deactivator, phenolic compound, and substituted succinic acid or anhydride used to inhibit fouling in hydrocarbon process fluids.

One particularly successful group of antifoulants is reported in U.S. Pat. No. 4,578,178 (Forester—of common assignment herewith). This patent discloses the use of polyalkenylthiophosphonic acid esters with the Group II(a) cation salts thereof being specified in U.S. Pat. No. 4,775,459 (Forester—of common assignment herewith).

DETAILED DESCRIPTION

I have found that reaction products of the type disclosed in U.S. Pat. No. 4,401,581 (Burrows et al), hereby incorporated by reference herein, provide significant antifoulant efficacy in liquid hydrocarbonaceous mediums during the high temperature treatment of the medium. It is to be understood that the phrase "liquid hydrocarbonaceous medium" as used herein signifies various and sundry petroleum hydrocarbons and petrochemicals. For instance, petroleum hydrocarbons such as petroleum hydrocarbon feedstocks including crude oils and fractions thereof such as naphtha, gasoline, kerosene, diesel, jet fuel, fuel oil, gas oil, vacuum residua, etc., are all included in the definition.

Similarly, petrochemicals such as olefinic or naphthenic process streams, aromatic hydrocarbons and their derivatives, ethylene dichloride, and ethylene glycol are all considered to be within the ambit of the phrase "liquid hydrocarbonaceous mediums".

The reaction products, as stated in the '581 patent, are made via reaction of an (a) hydrocarbon-substituted succinic acid or anhydride wherein the hydrocarbon moiety substituent has an average weight of from about 700-5000; (b) an alcohol containing from 1-6 hydroxy groups and from about 1-40 carbon atoms; (c) a primary or secondary hydroxy substituted amine containing 1-3 hydroxy groups; (d) a polyalkenylsuccinimide formed from reaction of a polyalkenylsuccinic acid or anhydride with a polyamine; and (e) a polyoxyalkyleneamine. The reactants are employed in a molar ratio (a):(b):(c):(d):(e) of from 1:0.1-1.0:0.01-1.0:0.01-2.5:0.0-05-1.0.

As to the compounds (a) as stated by Burrows et al, there are well known polyalkenylsuccinic acid or corresponding polyalkenylsuccinic anhydride compounds. They may be purchased from a plurality of suppliers, with the preferred (a), polyisobutenylsuccinic anhydride being sold by Texaco under the trademark TLA-627. This particular compound is a polyisobutenylsuccinic anhydride (PIBSA) having the structure

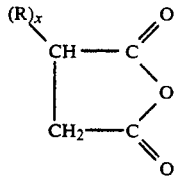

(I)

wherein, in this case, R is an isobutenyl repeat unit. The average molecular weight of the polyisobutene used to produce the PIBSA is about 1300.

The preferred component (a) polyalkenylsuccinic anhydride (PIBSA) may also be prepared as reported in U.S. Pat. No. 3,235,484 (Colfer), incorporated herein by reference or, more preferably, by the methods reported in U.S. Pat. No. 4,883,886 (Huang) also incorporated by reference herein. As to the Colfer method, the anhydride may be prepared by reaction of maleic anhydride with a high molecular weight olefin or a chlorinated high molecular weight olefin. In the preferred Huang method, reaction of a polymer of a $C_2$-$C_8$ olefin and maleic anhydride are carried out in the presence of a tar and side product suppressing agent.

The most commonly used sources for forming the aliphatic R substituent on the succinic anhydride compound are the polyolefins, such as polyethylene, polypropylene, polyisobutene, polyamylene, polyisohexylene, etc. The most particularly preferred polyolefin (and the one used to manufacture the preferred polyisobutenylsuccinic anhydride—PIBSA—from Texaco) is polyisobutene. As Colfer states, particular preference is made for such a polyisobutene-containing at least about 50 carbon atoms, preferably from at least 60 carbon atoms and most desirably from about 100 to about 130 carbon atoms. Accordingly, an operable carbon atom number range for R is from about 30-200 carbon atoms.

It is to be kept in mind that although the polyalkenylsuccinic anhydride compounds are preferred, similar succinic acid compounds may also be employed.

As to the mono to hexa-hydroxy alcohol, compounds (b), these may comprise those considered by Burrows et al. More specifically, they can include methanol, isobutanol, dodecanol, eicosanol, triacontanol, hentriacontanol, octatriacontanol, ethylene glycol, diethylene glycol, triethylene glycol, propylene glycol, glycerol, sorbitol, mannitol, sorbitan, mannitan, octadecanol, pentaerythritol, dipentaerythritol, and the like. These compounds may be described as monohydroxy and polyhydroxy alcohols containing up to about six hydroxy groups. The preferred alcohols contain 1 to about 4 hydroxy groups and 1 to about 40 carbon atoms.

As per Burrows et al, the more preferred alcohols are the hindered polyols containing about 5-10 carbon atoms and 3-4 hydroxy groups. Representative examples are trismethylolethane, trismethylolpropane, trismethylolbutane, and pentaerythritol. Although not preferred, ethers of these polyols can be used such as bispentaerythritol.

Pentaerythritol is presently preferred for use as component (b).

Turning now to exemplary primary or secondary hydroxy substituted amines containing 1-3 hydroxy groups, compounds (c), these include such amines which have an amino nitrogen and at least one reactive H atom bonded to said nitrogen. The amines contain from 1-3 hydroxy substituents and can preferably comprise from about 2-20 carbon atoms. These amines include ethanolamine, diethanolamine, propanolamine, N-ethanoldodecylamine, N-ethanololeylamine, N-ethanolethylenediamine, ethylene oxide treated polyethyleneamines, such as oxyalkylated diethylenetriamine, triethylenetetramine, tetraethylene pentamine, pentaethylenehexamine, etc. The preferred compound is trishydroxymethylaminomethane (THAM).

Processes for preparing polyalkenylsuccinimide compounds (d) are reported, for instance, in U.S. Pat. Nos. 3,219,666; 3,172,892; 2,182,178; and 2,490,744, as well as in the aforementioned Colfer patent. Basically, these compounds are prepared via reaction of a hydrocarbyl succinic anhydride, acid or ester with an amine. Again, the hydrocarbyl substituent is normally derived from a polyolefin, such as polypropylene or polyisobutylene containing from 12 to about 200 carbon atoms. The most preferred hydrocarbyl substituents are derived from polyisobutylene containing about 50-200 carbon atoms (mol wt. about 700-2800).

Preferably the polyalkenylsuccinic anhydride or acid is reacted with a polyamine having the structure

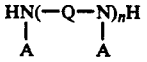

(II)

in which n is an integer, A is chosen from hydrocarbyl, hydroxyalkyl or hydrogen with the proviso that at least one A is hydrogen. Q signifies a divalent aliphatic radical. As Colfer indicates, the A substituents can be considered as forming a divalent alkylene radical, thus resulting in a cyclic structure. Q generally, however, is a $C_1$-$C_5$ alkylene, such as ethylene, trimethylene, tetramethylene, etc. Q is most preferably ethylene.

Accordingly, exemplary amine components (II) may comprise ethylenediamine, triethylenetetramine, diethylenetriamine, trimethylenediamine, bis(trimethylene)triamine, tris(trimethylene)tetramine, tris(hexamethylene)tetramine, decamethylenediamine, N-octyl trimethylenediamine, N,N'-dioctyltrimethylenediamine, N(2-hydroxyethyl)ethylenediamine, piperazine, 1-(2-aminopropyl)piperazine, 1,4-bis(2-aminoethyl)piperazine, 1-(2-hydroxyethyl)piperazine, bis(hydroxypropyl)substituted tetraethylenepentamine, N-3-(hydroxypropyl)tetramethylenediamine, pyrimidine, 2-methylimidazoline, polymerized ethyleneimine, and 1,3-bis(2-aminoethyl)imidazoline.

The reaction of the precursor, preferred, polyalkenylsuccinic anhydride (I) with amine (II) to form polyalkenylsuccinimide, component d, is conducted at temperature in excess of 80° C. with use of a solvent, such as benzene, xylene, toluene, naphtha, mineral oil, n-hexane, etc. Preferably, the reaction is conducted at from 100°-250° C. with a molar amount of precursor anhydride (I): amine (II) being from about 1:5 to about 5:1 with a molar amount of 1-3:1 being preferred.

The preferred component (d) is a polyisobutenylsuccinimide prepared from polyisobutenylsuccinic anhydride (MW isobutenyl moiety ≈ 1300) reacted with tetraethylenepentamine in a molar ratio of about 1.5-2/1.

Component, (e), a polyoxyalkyleneamine includes compounds of the formula (III)

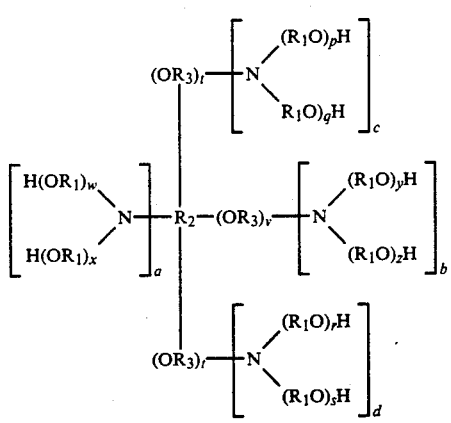

wherein each $R_1$, when present, is independently chosen from $C_1$-$C_8$ alkylene, $R_2$ is $C_1$-$C_{20}$ alkylene, each $R_3$, when present, is independent and is independently chosen from $C_1$-$C_8$ alkylene; a, b, c, and d are each independent and are 0 or 1 with the proviso that at least one of a, b, c, and d is present; p, q, r, s, t, v, w, x, y and z are independently chosen from integers of from 0 to 100.

The oxyalkyleneamines (III) include the "Jeffamine" ® series mono, di, and triamines which are available from Texaco Chemical Company. These are preferred for use as the component (e). Exemplary oxyalkyleneamines (III) include ethoxylated and/or propoxylated polyamines such as $$NH_2-CH(CH_3)CH_2-[OCH_2CH(CH_3)]_x-NH_2 \text{ or}$$

$$NH_2-CH(CH_3)CH_2-[OCHCH_3CH_2]_x-[OCH_2CH_2]_y-[OCH_2CH(CH_3)]_x-NH_2 \text{ OR}$$

$$CH_3-CH_2-\overset{\displaystyle CH_2-[OCH_2CH(CH_3)]_x-NH_2}{\underset{\displaystyle CH_2-[OCH_2CH(CH_3)]_z-NH_2}{\overset{|}{\underset{|}{C}}}}-CH_2-[OCH_2CH(CH_3)]_y-NH_2$$

with x, y and z as defined in formula III.

The "Jeffamines" are sold under a plurality of designations, including the preferred D-400 designation. Other designations include: D-230, D-2000, and T-403. The D-400 product is described as a polyoxypropylene amine.

The Burrows et al patent indicates that in one alternative reaction scheme, the components (a), (b), (c), (d), and (e) are all mixed together in the temperature range of 100°-350° C., more preferably 175°-300° C. Also, the patent indicates that a two-step process may be employed wherein components (a), (b), and (c) are first reacted with the product of this (a)(b)(c) reaction used as a reactant for reaction with components (d) and (e) to form the desired product in accordance with the invention. The reaction (s) may proceed under a nitrogen blanket in the presence of an acid catalyst, such as p-toluene sulfonic acid.

The reaction product may be added to or dispersed within the liquid hydrocarbonaceous medium in need of antifouling protection in an amount of 0.5-10,000 ppm based upon one million parts of the liquid hydrocarbonaceous medium. Preferably, the reaction product antifoulant is added in an amount of from 1 to 2500 ppm.

The reaction product may be dissolved in a non-polar organic solvent, such as heavy aromatic naphtha, toluene, xylene, or mineral oil and fed to the hot process fluid or it can be fed neat thereto. The reaction products are especially effective when added to the liquid hydrocarbonaceous medium during the heat processing thereof at temperatures of from about 100°-550° C.

EXAMPLES

The following examples are intended as being illustrative and should not be viewed as restricting the scope of the invention.

EXAMPLE 1

PBSATPA PREPARATION

Polyisobutenyl succinic anhydride (PIBSA) (mw ≈ 1300 isobutenyl moiety) was reacted with trishydroxymethylaminomethane (THAM) and pentaerythritol (PE) in a 1:0.78:0.91 mole ratio as per the disclosure of Example 7 of U.S. Pat. No. 4,401,581 (Burrows et al). The resulting reaction product was then further reacted with a polyoxypropylamine (Jeffamine 400) and a tetraethylenepentamine polyisobutenylsuccinimide in a 1.0:.018:0.25 molar ratio in accordance with the parameters given in Example 7 of Burrows et al for the second step of the reaction. The product was diluted to 50% active concentration in mineral oil and used for efficacy testing.

EXAMPLE 2

EFFICACY

In order to ascertain the efficacy of the candidate reaction products in inhibiting deposit formation in liquid hydrocarbonaceous mediums during elevated temperature treatment, test materials were subjected to a dual fouling apparatus test. In the dual fouling apparatus, process fluid (crude oil) is pumped from a Parr bomb through a heat exchanger containing an electrically heated rod. Then the process fluid is chilled back to room temperature in a water-cooled condenser before being remixed with the fluid in the bomb.

The Dual Fouling Apparatus (DFA) used to generate the data shown in the following Table contains two independent, heated rod exchangers. In the DFA tests, rod temperature was controlled while testing. As fouling on the rod occurs, less heat is transferred to the fluid so that the process fluid outlet temperature decreases. Antifoulant protection was determined by comparing the summed areas between the heat transfer curves for control and treated runs and the ideal case for each run. In this method, the temperatures of the oil inlet and outlet and rod temperatures at the oil inlet (cold end) and outlet (hot end) are used to calculate U-rig coefficients of heat transfer every 2 minutes during the tests. From these U-rig coefficients, areas under the fouling curves are calculated and subtracted from the non-fouling curve for each run. Comparing the areas of control runs (averaged) and treated runs in the following equation results in a percent protection value for antifoulants.

$$\frac{\text{Avg. }\Delta\text{Area(control)} - \Delta\text{Area(treatment)}}{\text{Avg. }\Delta\text{Area(control)}} \times 100 = \%\text{ protection}$$

Results are shown in Table I following.

TABLE I

| Additive | ppm | Rod Temp. | % Protection |
|---|---|---|---|
| | Desalted Crude Oil A | | |
| PIBSI | 62.5 | 482° C. | 8 (avg.) |
| | 125 | 482° C. | 9 |
| | 250 | 482° C. | 18 |
| PBSATPA | 62.5 | 482° C. | 2 (avg.) |
| | 125 | 482° C. | 69 |
| | 250 | 482° C. | 32 |

PIBSI - Polyisobutenylsuccinimide; mw isobutenyl moiety ≈ 1300; available from Lubrizol
pBSATPA - Example 1 reaction product

EXAMPLE 3

An additional series of test runs were performed on the dual fouling apparatus to assess efficacy. Results are reported in Table II.

TABLE II

| Additive | ppm | Rod Temp. °C. | % Protection |
|---|---|---|---|
| | Desalted Crude Oil #3 Mix B | | |
| PIBSI | 62.5 | 454 | 17 |
| PBSATPA | 62.5 | 454 | 41 |
| PIBSI | 250 | 454 | 17 |
| PBSATPA | 250 | 454 | 44 |
| | Desalted Crude Oil #4 Mix C | | |
| PIBSI | 250 | 413 | 42 |
| PBSATPA | 250 | 413 | 4 |
| PIBSI | 250 | 441 | 50 |
| PBSATPA | 250 | 441 | −8 |
| | Desalted Crude Oil Mix D | | |
| PIBSI | 500 | 316 | 33, 97 (65 avg.) |

TABLE II-continued

| Additive | ppm | Rod Temp. °C. | % Protection |
|---|---|---|---|
| PBSATPA | 500 | 316 | 100, −13 (44 avg.) |

PIBSI and PBSATPA are the same as identified in Example 2.

EXAMPLE 4

Another series of tests adapted to assess candidate efficacy in providing fouling inhibition during high temperature treatment of liquid hydrocarbon mediums were performed. These tests are titled, "Hot Filament Fouling Tests" and were run in conjunction with gas oil hydrocarbon mediums. The procedure for these tests involves the following.

HOT FILAMENT FOULING TESTS (HFFT)

A preweighed 24 gauge Ni-chrome wire is placed between two brass electrodes in a glass reaction jar and is held in place by two brass screws. 200 mls of feedstock are measured and added into each sample jar. One sample jar is left untreated as a control with other jars being supplied with from 31 to 125 ppm (active) of the candidate material.

The brass electrode assembly and lids are placed on each jar and tightly secured. The treatments are mixed via swirling the feedstock. Four sample jars are connected in series with a controller provided for each series of jars.

The controllers are turned on and provide 8 amps of current to each jar. This amperage provides a temperature of about 125°-150° C. within each sample jar. After 24 hours of current flow, the controllers are turned off and the jars are disconnected from their series connection. The wires, which have been immersed in the hot medium during the testing, are carefully removed from their jars, are washed with xylene and acetone, and are allowed to dry.

Each wire and the resulting deposits thereon are weighed with the weight of the deposit being calculated. Photographs of the wires are taken comparing untreated, treated, and clean wires from each series of experiments using a given controller.

The deposit weight for a given wire was calculated in accordance with $$\text{wt. deposit} = \left(\begin{matrix}\text{weight of wire}\\ \text{plus deposit}\end{matrix}\right) - (\text{original wire weight})$$

The percentage protection for each treatment sample was then calculated as follows:

$$\%\text{ protection} = \left[1 - \frac{\text{wt. deposit(treated)}}{\text{wt. deposit(untreated)}}\right] \times 100$$

Results are shown in Table III.

TABLE III

| Additive | ppm Actives | Feedstock Type | % Protection |
|---|---|---|---|
| PIBSI | 31 | SRLGO | 78 |
| PIBSI | 125 | SRLGO | 40 avg. |
| PBSATPA | 125 | SRLGO | 54 |
| PIBSI | 31 | CCLGO | 33 |
| PIBSI | 125 | CCLGO | 89 |

TABLE III-continued

| Additive | ppm Actives | Feedstock Type | % Protection |
|---|---|---|---|
| PBSATPA | 125 | CCLGO | 90 |

PIBSI and PBSATPA are the same as reported in the previous examples.
SRLGO = straight run light gas oil
CCLGO = catalytically cracked light gas oil In accordance with the above examples, it can be seen that the PBSATPA reaction product provides, in most instances, substantially better antifoulant protection in the tested hydrocarbon mediums during the heat treatment of the medium at elevated temperatures.

In accordance with the patent statutes, the best mode of practicing the invention has been set forth. However, it will be apparent to those skilled in the art that many other modifications can be made without departing from the invention herein disclosed and described.

I claim:

1. A method of inhibiting fouling deposit formation in a liquid hydrocarbonaceous medium during heat processing of said medium at temperatures of from about 200° C.–550° C., wherein, in the absence of such antifouling treatment, fouling deposits are normally formed as a separate phase within said liquid hydrocarbonaceous medium impeding process throughput and thermal transfer, said method comprising adding to said liquid hydrocarbonaceous medium an effective antifouling amount of a reaction product of (a) hydrocarbon substituted succinic acid or anhydride wherein said hydrocarbon substituent has a molecular weight of about 700–5000;

(b) an alcohol having from about 1 to 6 hydroxy groups;

(c) a primary or secondary hydroxy substituted amine containing 1–3 hydroxyl groups;

(d) a polyalkenylsuccinimide formed from reaction of a polyalkenylsuccinic acid or anhydride with a polyamine; and (e) a polyoxyalkyleneamine.

2. A method as recited in claim 1 further comprising adding from about 0.5–10,000 parts, by weight, of said reaction product to said liquid hydrocarbonaceous medium based upon one million parts of said hydrocarbonaceous medium.

3. A method as recited in claim 2 wherein said liquid hydrocarbonaceous medium comprises crude oil, straight run light gas oil, or catalytically cracked light gas oil.

4. A method as recited in claim 2 wherein:

(a) comprises polyalkenylsuccinic anhydride;

(b) comprises a hindered polyol having about 5–10 carbon atoms and 3–4 hydroxy groups;

(d) comprises a polyalkenylsuccinimide derived from reaction of polyalkenylsuccinic anhydride with a polyamine having the structure $$\underset{\underset{A}{|}}{HN}(-Q-\underset{\underset{A}{|}}{N})_nH$$

wherein A is chosen from hydrocarbyl, hydroxyalkyl or hydroxyalkyl or hydrogen with the proviso that at least one A is hydrogen, Q is a divalent aliphatic radical, and n is an integer.

5. A method as recited in claim 4 wherein (a) comprises polyisobutenylsuccinic anhydride wherein the molecular weight of the polyisobutenyl moiety is about 1300.

6. A method as recited in claim 5 wherein said hindered polyol, component (b) is pentaerythritol.

7. A method as recited in claim 5 wherein said component (c) comprises trishydroxymethylaminomethane.

8. A method as recited in claim 5 wherein said Q in said component (d) comprises $C_1$–$C_5$ alkylene and wherein A is hydrogen.

9. A method as recited in claim 8 wherein Q in said component (d) comprises ethylene.

10. A method as recited in claim 9 wherein in component (d) said polyalkenylsuccinic anhydride is polyisobutenylsuccinic anhydride wherein the molecular weight of the polyisobutenyl moiety thereof is about 1300.

11. A method as recited in claim 10 wherein said component (c) comprises a polyoxyethyleneamine or polyoxypropyleneamine.

12. A method as recited in claim 9 wherein said polyamine is triethylenetetramine or tetraethylenepentamine.

13. A method as recited in claim 12 wherein said component (c) comprises polyoxypropylene amine.

* * * * *